United States Patent [19]

Bühler

[11] 4,167,642

[45] Sep. 11, 1979

[54] COLUMN FOR SUPPORTING, RAISING AND SWIVELLING THE ROOF OF AN ARC FURNACE

[75] Inventor: Karl Bühler, Nussbaumen, Switzerland

[73] Assignee: BBC Brown Boveri & Company, Limited, Baden, Switzerland

[21] Appl. No.: 878,891

[22] Filed: Feb. 17, 1978

[30] Foreign Application Priority Data

Mar. 8, 1977 [CH] Switzerland ..... 2860/77

[51] Int. Cl.[2] ..... H05B 7/10

[52] U.S. Cl. ..... 13/14

[58] Field of Search ..... 13/9, 10, 14–17, 13/13, 33; 174/45; 110/335; 52/725

[56] References Cited

U.S. PATENT DOCUMENTS

| | | | |
|---|---|---|---|
| 2,551,941 | 5/1951 | Greene | 13/10 |
| 3,958,381 | 5/1976 | Meyer | 52/725 X |

*Primary Examiner*—Roy N. Envall, Jr.

*Attorney, Agent, or Firm*—Oblon, Fisher, Spivak, McClelland & Maier

[57] ABSTRACT

A column for supporting, raising and swivelling the roof of an arc furnance, in which the column comprises an iron tube filled at least partly with a solid filter material, preferably concrete, plaster or synthetic resin.

10 Claims, 10 Drawing Figures

COLUMN FOR SUPPORTING, RAISING AND SWIVELLING THE ROOF OF AN ARC FURNACE

BACKGROUND OF THE INVENTION

1. Field of the Invention

The present invention relates generally to arc furnaces and more particularly to an improved sturcture for moving the roof thereof during charging operations.

2. Description of the Prior Art

The generally accepted method of operating arc furnaces today is to charge the furnaces by means of so-called charging buckets. For this purpose, all the furnace components above the furnace shell, i.e. the roof and superstructure, have to be brought temporarily to the side so that the charging bucket can be moved over the furance and emptied thereinto.

Various constructions have heretofore been used to achieve this purpose. With one of these, the furnace superstructure, with the furnace roof suspended therefrom, can be swivelled about a round column standing next to the furnace shell. A configuration of this kind is illustrated on page 3 of an undated brochure entitled "Massbild zu Lichtbogen-Schmelzofen, Typen SSKD 260-390" and published by BBC Brown Boveri & Company, Limited, Baden, Switzerland.

The arrangement described results in an eccentric bending load on the column and has to be dimensioned according to the maximum permissible bending stress and/or the deflection that must not be exceeded. Even with medium-sized furnaces, both these criteria give rise to steel forgings or castings which are of substantial size and relatively expensive. Hollow steel castings are also expensive. Endeavors to perform the roof swivelling function in another way not requiring a rotating column, however, do not lead to space-saving constructions such as are offered by the rotating column. The problem is therefore to find a less expensive solution for the rotating column.

SUMMARY OF THE INVENTION

Accordingly, one object of this invention is to provide a novel supporting column for raising and swivelling the roof of an arc furnace which does not exhibit the disadvantages of heretofore known rotating columns, such as indicated herein, and which additionally permits a significant saving of material and simpler manufacture, while at the same time providing adequate mechanical strength. Deformation of the cross-section of the rotating column is to be minimal so as to ensure faultless operation.

This object is achieved at least in accordance with one aspect of the present invention by the provision of a supporting column formed of an iron tube filled at least partly with a solid filler material, e.g. concrete, plaster or synthetic resin.

An advantage of the present invention lies particularly in the fact that, with the iron tube, a greater diameter is obtained with comparatively little material. In this way, a considerable saving in material is achieved and the tube is deformed less than a solid body formed of the same amount of material and subjected to the same stresses. Filling the iron tube at least partly with a solid filler material, e.g. concrete, plaster or synthetic resin, strengthens the relatively thin-walled iron tube against buckling in response to the bending moment. If the tube is filled at least partly with concrete, the construction obtained is not only strong, but also economical.

In a preferred alternative form, the iron tube is completely filled with the solid filler material. This configuration has the advantage that the supporting column can be filled very simply in one operation.

In another alternative form, the interior of the iron tube is filled with the solid filler material only in an outer zone thereof, as viewed radially, or in an annular form. With this solution, a lighter construction and a further saving in material is obtained. The mechanical strength in respect of the bending moment remains adequate, however.

BRIEF DESCRIPTION OF THE DRAWINGS

A more complete appreciation of the present invention and many of the attendant advantages thereof will be readily obtained as the same becomes better understood by the reference to the following detailed description when considered in connection with the accompanying drawings, in which like reference characters designate like or corresponding parts throughout the several views and wherein.

DESCRIPTION OF THE PREFERRED EMBODIMENTS

Figure 1:
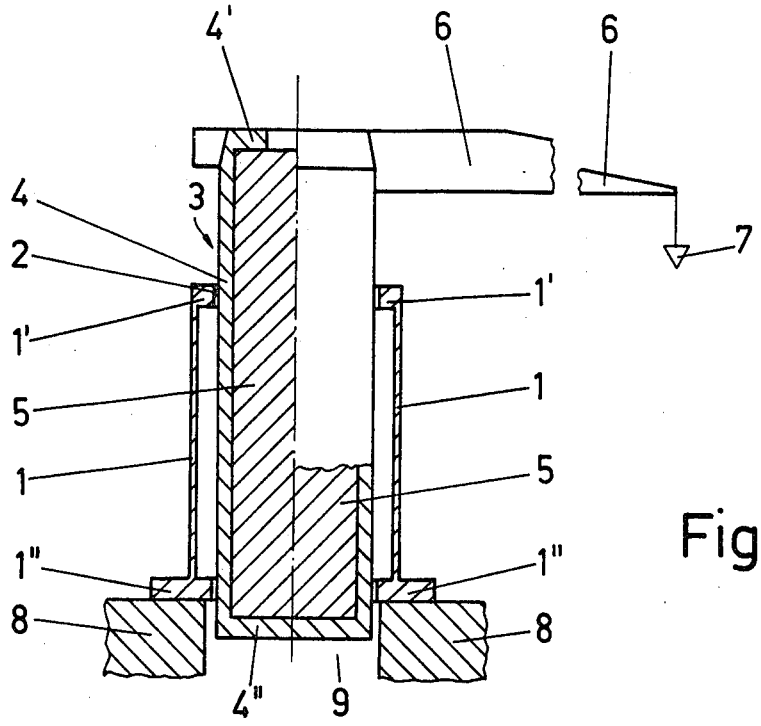
FIG. 1 shows, by way of example and in cross-section, a first embodiment of the present invention having a completely filled supporting column.

Referring now to the drawings, and more particularly to FIG. 1, a vertically oriented cylinder 1 is shown, being integrally formed with an annular base plate 1'', which alternatively may be welded thereto, if desired. The upper portion of the cylinder 1 is provided with a guide 1' in which a seal 2 is located.

Passing through the seal 2 is a piston generally designated by the reference numeral 3 and being formed of an iron tube 4 which is completely filled with a filler material 5, such as, for example, concrete. The iron tube 4 is provided with an upper end plate 4' and a lower end plate 4''. The thickness of the wall of the iron tube 4 is preferably about or less than one-eighth the diameter of the tube. The upper part of the piston 3 is rigidly connected to an arm 6, shown only schematically, to the end of which a load 7 is attached, indicated schematically by an arrow 7. The base plate 1'' is fastened by means of bolts, not shown, to a foundation 8 in which there is a central opening 9 for receiving the lower end of the piston 3.

By filling the iron tube 4 with concrete, good mechanical strength is obtained with regard to the bending moment caused by the arm 6 and load 7.

Figure 2:
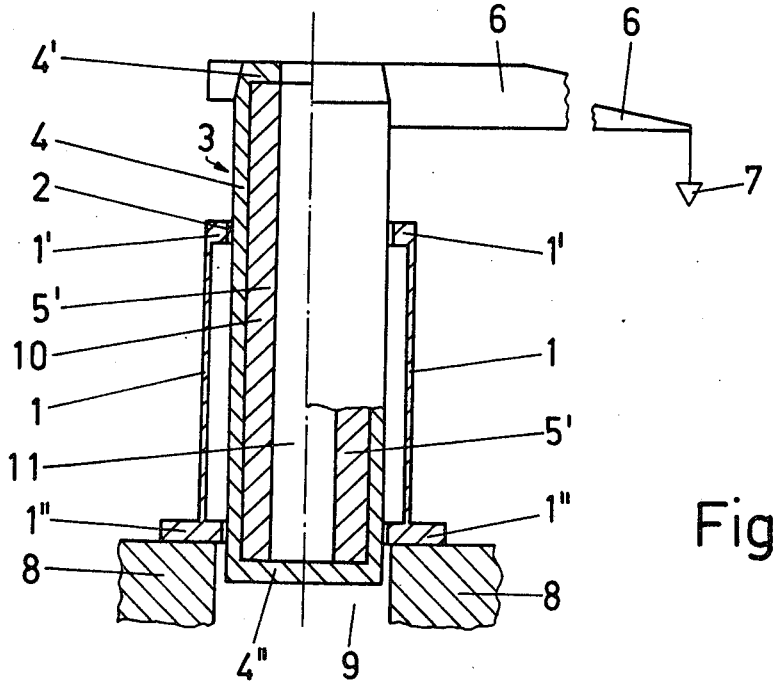
FIG. 2 is a sectional view of another embodiment having only a partially filled supporting column.

The arrangement shown in FIG. 2 corresponds in part to that of FIG. 1. The iron tube 4, however, is filled only partially with the solid filler material 5', in the outer zone 10 of the interior of the iron tube 4, or in an annular or tubular form, and the inner zone 11, of cylindrical form, of the tube 4 is therfore not filled. A certain quantity of the solid filler material 5' is saved in this way, and yet the bending strength of the piston 3 is still adequate.

Figure 3:
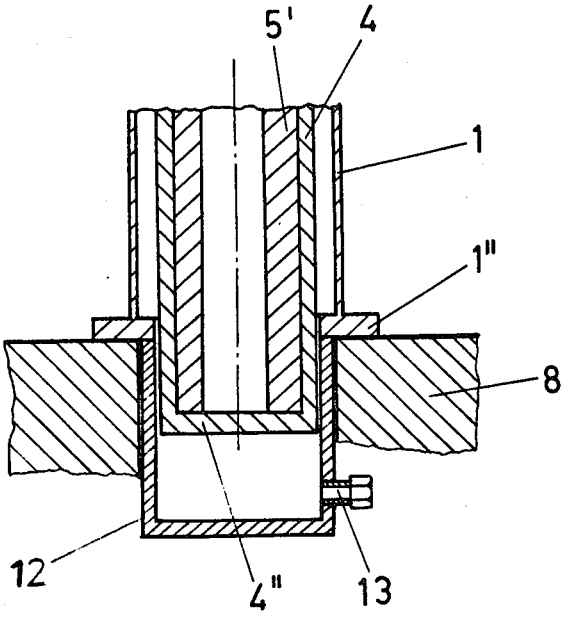
FIG. 3 shows the lower part of the embodiment shown in FIG. 2, with a hydraulic device acting on the supporting column.

FIG. 3 shows the lower part of an embodiment like that shown in FIG. 2, with a cylinder 12 being mounted on the base plate 1" and disposed in the opening 9 of foundation 8. The cylinder 12 is closed at its lower end and is provided with a connector 13 to which a supply line for hydraulic fluid can be connected. The piston 3 is at the same time intended as the piston of the hydraulic system. The piston 3 is thus raised by increasing the pressure of the hydraulic fluid in the cylinder 12, and lowered by reducing the pressure.

The piston 3 can, of course, also be provided with a different device for effecting vertical movement and/or radial or swivelling movement thereof about its axis.

Obviously, numerous additional modifications and variations of the present invention are possible in light of the above teachings. For example, instead of the cylinder 1 as illustrated, another known form could be used, e.g. one with reinforcing ribs. The foundation 8 can also be made without an opening, in which case the piston 3 would be movable only above the foundation. It is therefore to be understood that within the scope of the appended claims, the invention may be practiced otherwise than as specifically described herein.

What is claimed as new and desired to be secured by Letters Patent of the United States is:

1. A column for supporting, raising and swivelling the roof of an arc furnace comprising:

a foundation;

a vertically oriented cylinder mounted on said foundation;

an iron tube disposed in said cylinder and vertically movable therein, with the upper end of said iron tube extending from the upper end of said cylinder, said upper end of said iron tube being adapted to support the arc furnace roof; and said iron tube being at least partially filled with a solid filler material.

2. A column as claimed in claim 1, wherein said filler material is concrete.

3. A column as claimed in claim 1, wherein said filler material is plaster.

4. A column as claimed in claim 1, wherein said filler material is synthetic resin.

5. A column as claimed in claim 1, wherein the iron tube is completely filled with the solid filler material.

6. A column as claimed in claim 1, wherein the interior of the iron tube is filled with the solid filler material only in an outer zone thereof, as viewed radially.

7. A column as claimed in claim 1, wherein the iron tube has a wall thickness of less than $\frac{1}{8}$ of its diameter.

8. A column as claimed in claim 1, wherein said iron tube further comprises an upper end plate and a lower end plate, the end plates and the iron tube thereby constituting a piston vertically movable in said cylinder, and further comprising hydraulic means for effecting movement of said piston.

9. A column as claimed in claim 1, wherein said iron tube further comprises a lower end plate, and further comprising means provided at said lower end plate of said iron tube for moving said iron tube vertically.

10. A column as claimed in claim 1 and further comprising means for moving said iron tube vertically and for swivelling said iron tube in said cylinder.

* * * * *